US006850199B2

(12) United States Patent
Chen et al.

(10) Patent No.: US 6,850,199 B2
(45) Date of Patent: Feb. 1, 2005

(54) U-SHAPED MULTI-FREQUENCY ANTENNA OF HIGH EFFICIENCY

(75) Inventors: I-Fong Chen, Tao-Yuan (TW); Chia-Mei Peng, Pingchun (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 0 days.

(21) Appl. No.: 10/458,311

(22) Filed: Jun. 11, 2003

(65) Prior Publication Data

US 2004/0252056 A1 Dec. 16, 2004

(51) Int. Cl.[7] ..... H01Q 1/24

(52) U.S. Cl. ..... 343/702; 343/700 MS

(58) Field of Search ..... 343/700 MS, 702, 343/741, 742, 821, 866

(56) References Cited

U.S. PATENT DOCUMENTS

| | | | | |
|---|---|---|---|---|
| 6,259,407 | B1 * | 7/2001 | Tran | 343/700 MS |
| 6,304,219 | B1 * | 10/2001 | Rothe | 343/700 MS |
| 6,542,128 | B1 * | 4/2003 | Johnson et al. | 343/742 |
| 6,653,984 | B2 * | 11/2003 | Park et al. | 343/770 |
| 6,677,905 | B2 * | 1/2004 | Deguchi et al. | 343/702 |
| 6,683,575 | B2 * | 1/2004 | Sekine et al. | 343/702 |

* cited by examiner

*Primary Examiner*—Tho Phan
(74) *Attorney, Agent, or Firm*—Troxell Law Office PLLC

(57) ABSTRACT

A U-shaped multi-frequency antenna of high efficiency, the antenna has a common feed line connected with an inner and an outer U-shaped wire in symmetrical forms respectively to decide impedance bandwidths of frequency bands selected, and has a balanced circuit of the structure of a Balun circuit having a gradually tapered microstrip to harmonize the impedance bandwidths. Thereby such an omni-directional multi-frequency antenna with a high gain and a bandwidth can be conveniently manufactured.

2 Claims, 8 Drawing Sheets

U-SHAPED MULTI-FREQUENCY ANTENNA OF HIGH EFFICIENCY

BACKGROUND OF THE INVENTION

1. Field of the Invention

The present invention is related to a U-shaped multi-frequency antenna of high efficiency, and especially to a monopole antenna particularly suitable for use in wireless local area networks (WLAN), it is an omni-directional multi-frequency antenna with a high gain and a bandwidth convenient for manufacturing.

2. Description of the Prior Art

Wireless communication keeps on fast growing in the fields including mobile phones, wireless Internet and wireless household electrical appliances; wireless local area networks (WLAN) are also included in the wireless networks.

The main bandwidths of WLAN used in the industry of scientific and medical (ISM) are 2.4–2.4835 GHz, 5.15–5.35 GHz and 5.725–5.825 GHz. Hence the antennas used in such a WLAN system must be able to handle more than two kinds of related bandwidths. Moreover, design of antennas of the WLAN system also include the consideration of larger bandwidths required, and the feature of simple impedance matching with a feed line.

SUMMARY OF THE INVENTION

The object of the present invention is to provide a U-shaped multi-frequency antenna of high efficiency, and especially to a monopole antenna particularly suitable for use in wireless local area networks (WLAN), it is an omni-directional multi-frequency antenna with high gain and bandwidth convenient for manufacturing.

To get the above stated object, the present invention has an inner and an outer U-shaped wire connected by a common feed ling for deciding impedance matching of selected bandwidths, and a balanced electric circuit with the structure of a Balun circuit having a gradually tapered microstrip is used to make harmonization of its impedance matching.

The present invention will be apparent after reading the detailed description of the preferred embodiment thereof in reference to the accompanying drawings.

DETAILED DESCRIPTION OF THE PREFERRED EMBODIMENT

Figure 1:
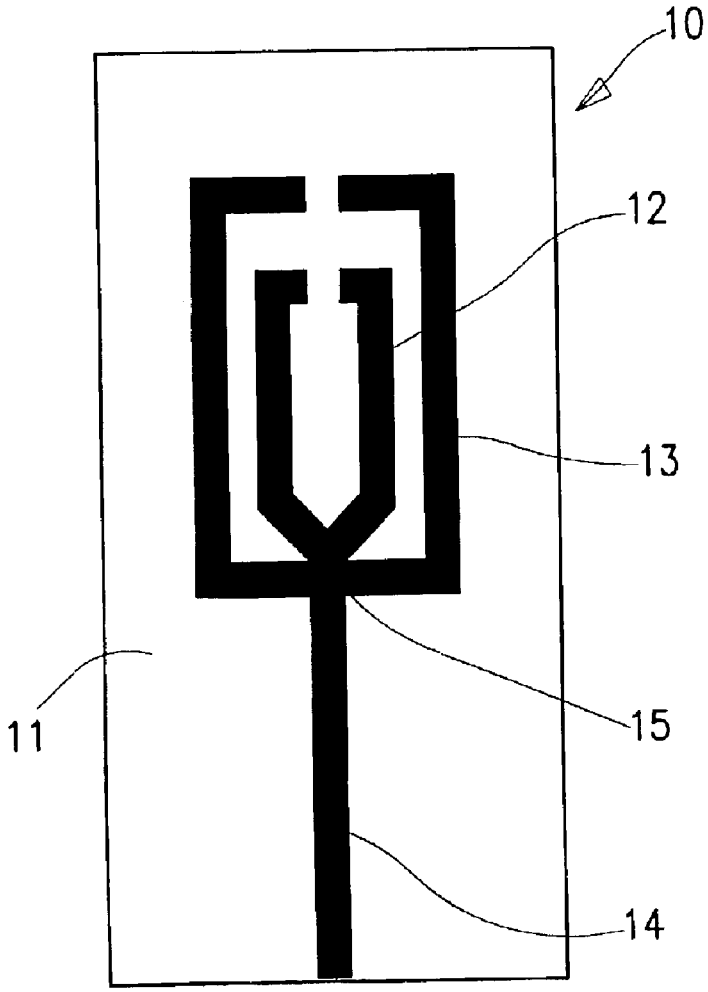
FIG. 1 is a front view showing the structure of a preferred embodiment of the present invention mounted on an electric circuit board.
Figure 2:
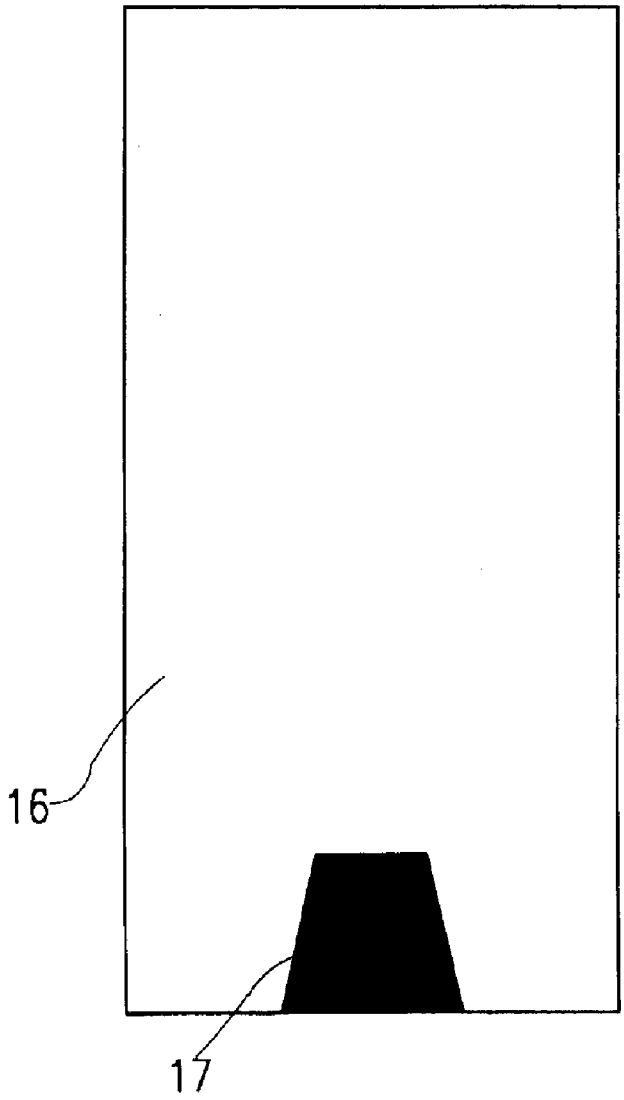
FIG. 2 is a back view of FIG. 1.

Referring to FIGS. 1, 2, as an example, the present invention is printed onto a baseboard 10, on the front side 11 thereof there is an antenna structure with two U-shaped wires in symmetrical forms respectively, such a radiating member includes a U-shaped high-frequency inner wire 12 and a U-shaped low-frequency outer wire 13. A common feed line 14 is connected with a bottom crossed feed-point 15 of the twin U-shaped antenna. The baseboard 10 is provided on the backside 16 thereof with a tapered microstrip Balun structure circuit 17 as a balanced circuit.

The lengths of the above stated U-shaped high-frequency inner wire 12 and U-shaped low-frequency outer wire 13 measured from the crossed feed-point 15 are respectively ¼ λ of the corresponding bands to be selected. Thereby, they form a monopole antenna-array able to increase the gain of radiation as well as bandwidths.

The impedance bandwidths and the impedance matching of the U-shaped high-frequency inner wire 12 and U-shaped low-frequency outer wire 13 can be harmonized by selecting the width and length of the tapered microstrip Balun structure circuit 17, while the basic resonant mode of the two wires are adjusted according to the lengths of the U-shaped wires to make the impedance matching of the U-shaped high-frequency inner wire 12 generate a high frequency of 5.35 GHz, and make the U-shaped low-frequency outer wire 13 a low frequency of 2.45 GHz.

Figure 3:
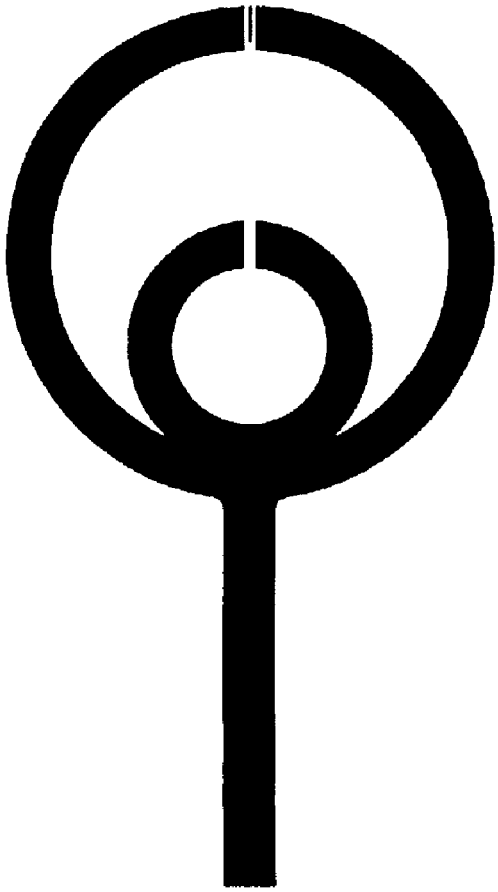
FIG. 3 is a plane view showing the structure of another preferred embodiment of the present invention.

Although the above embodiment of the present invention makes the U-shaped high-frequency inner wire 12 and the U-shaped low-frequency outer wire 13 have the forms of two U shapes with upper notches, however, they can also have the forms of two round U shapes as shown in FIG. 3.

Figure 4:
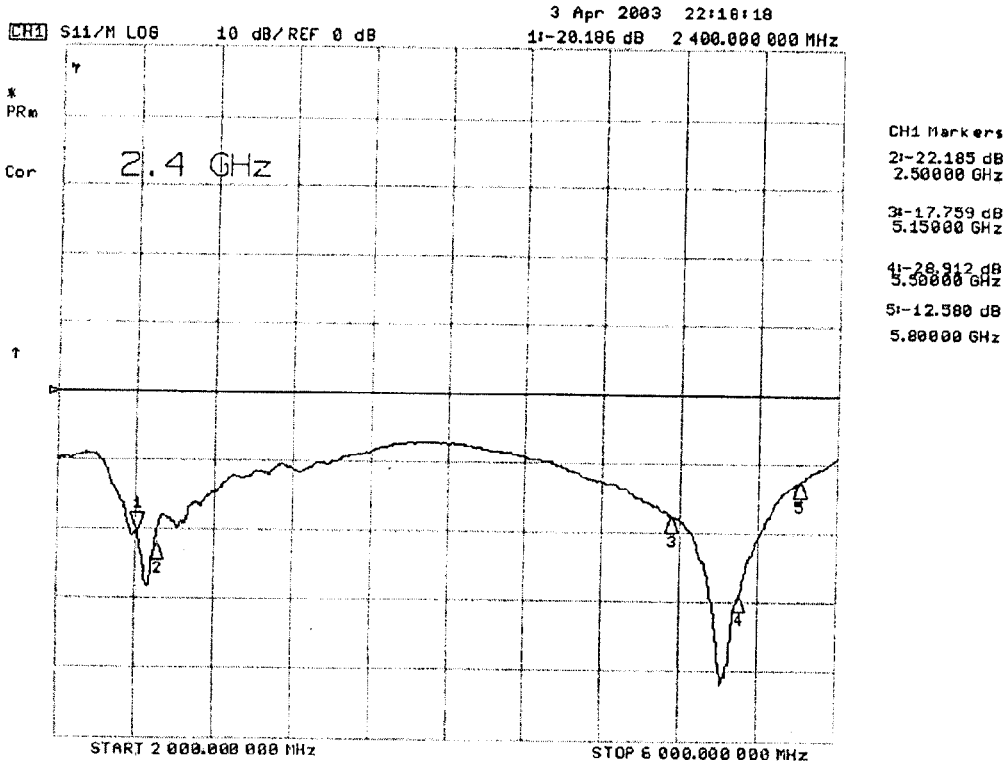
FIG. 4 is a test chart showing the ratios of loss.
Figure 5:
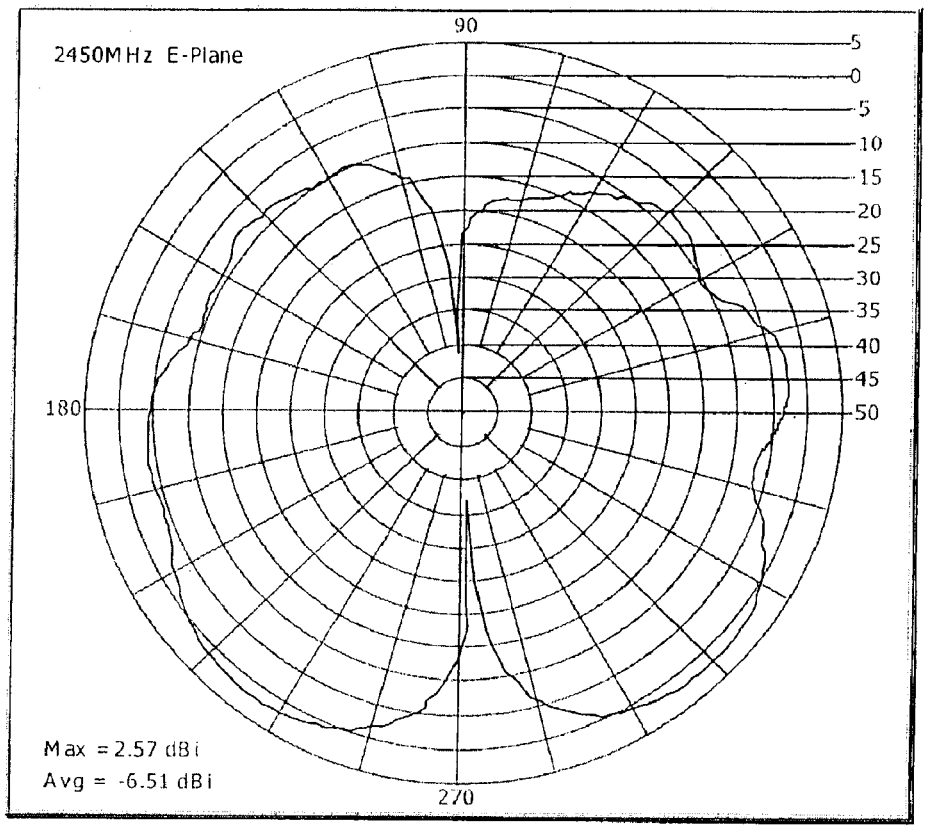
FIG. 5 is a chart showing an E-plane radiation field type of 2.45 GHz of the present invention.
Figure 6:
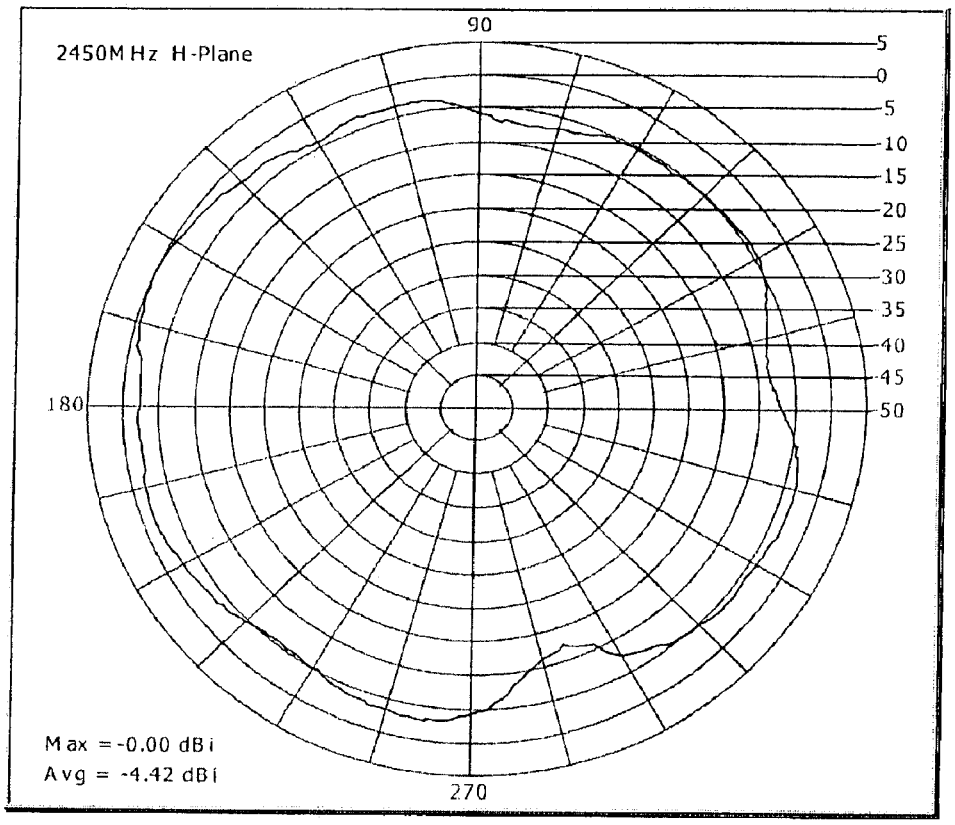
FIG. 6 is a chart showing an H-plane radiation field type of 2.45 GHz of the present invention.
Figure 7:
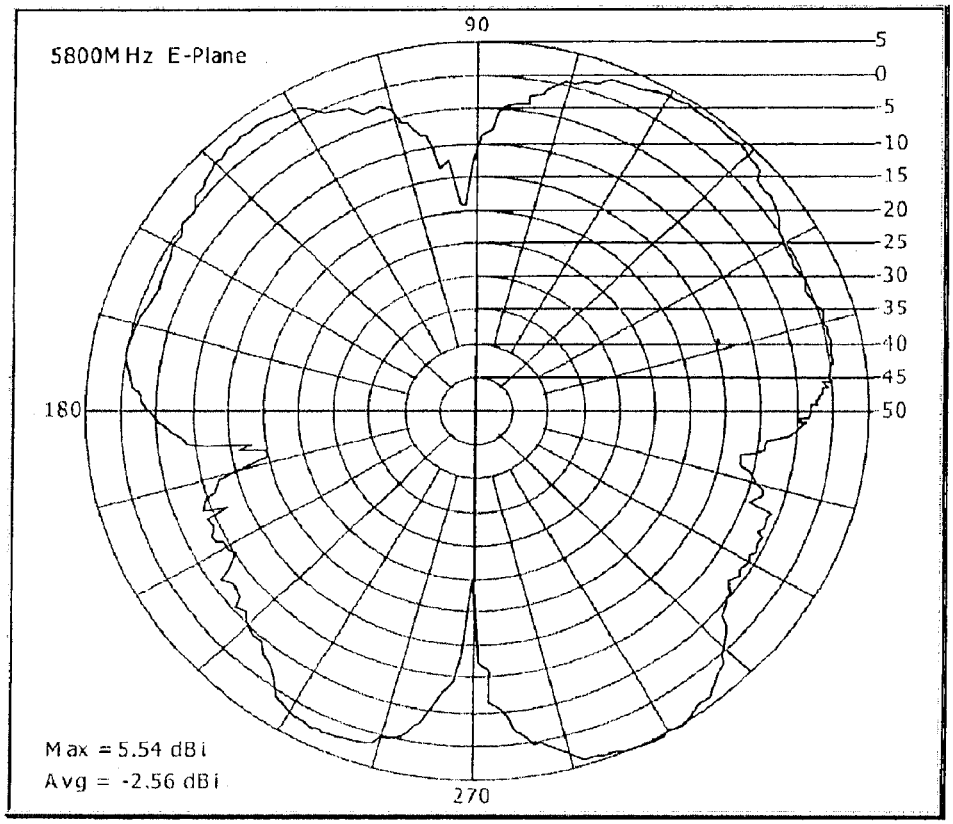
FIG. 7 is a chart showing an E-plane radiation field type of 5.8 GHz of the present invention.
Figure 8:
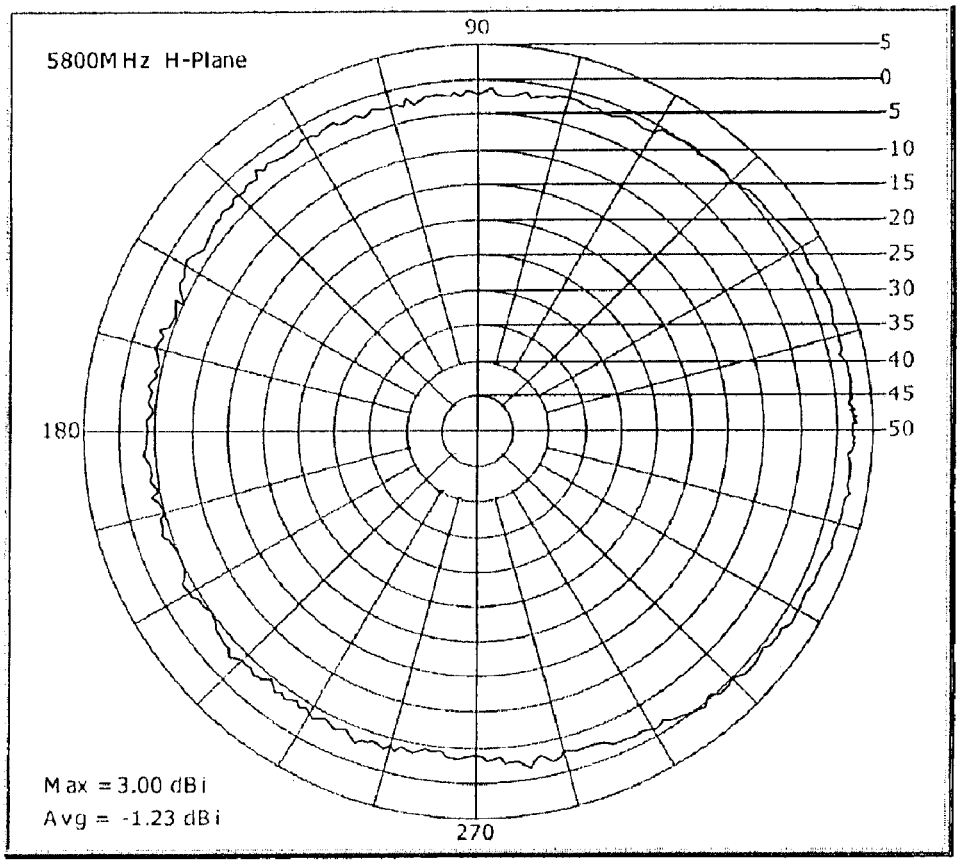
FIG. 8 is a chart showing an H-plane radiation field type of 5.8 GHz of the present invention.

When in testing the antenna structure as shown in FIGS. 1 and 2, its ratio of loss (return loss) is as shown in FIG. 4: ≦−10 dB. When it is the case of 2.45 GHz, as shown in FIG. 5, the gain of the E-plane is 2.75 dBi; the gain of the H-plane is 0 dBi (referring to FIG. 6). When it is the case of 5.8 GHz, as shown in FIGS. 7 and 8, it has good omni-directional attribute, the gain of the E-plane is 5.54 dBi; the gain of the H-plane is 3 dBi.

Thereby the antenna structure of the present invention as stated above is particularly suitable for application to ISM-bands 2.4/5.8 GHz WLAM. Its impedance matching is obtained from the balanced circuit, and its impedance bandwidths are decided by the lengths of and the space between the U-shaped wires. Therefore, it is an omni-directional multi-frequency antenna with a high gain and a bandwidth convenient for manufacturing.

The preferred embodiments stated are only for illustrating and not for giving any limitation to the scope of the present invention. It will be apparent to those skilled in this art that various modifications or changes made to the elements of the present invention without departing from the spirit and scope of this invention, such as to extend the conception of such designing to other bandwidths, shall fall within the scope of the appended claims.

What is claimed is:

1. A U-shaped multi-frequency antenna of high efficiency, said antenna has a common feed line, and an inner U-shaped wire and an outer U-shaped wire in symmetrical forms respectively; said feed line is connected with said U-shaped wires to decide impedance bandwidths of frequency bands selected, and said antenna has a balanced circuit to harmonize said impedance bandwidths, wherein said balanced circuit is of a structure of a Balun circuit having a gradually tapered microstrip.

2. The U-shaped multi-frequency antenna of high efficiency as defined in claim 1, wherein said impedance bandwidths are decided by lengths of and a space between said U-shaped wires.

* * * * *